US008727322B2

(12) United States Patent
Hall

(10) Patent No.: US 8,727,322 B2
(45) Date of Patent: May 20, 2014

(54) CONTROLLING THE WATER VAPOR LEVELS IN A CONFINED SPACE

(75) Inventor: David L. Hall, Piedmont, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 361 days.

(21) Appl. No.: 13/188,576

(22) Filed: Jul. 22, 2011

(65) Prior Publication Data

US 2013/0020729 A1 Jan. 24, 2013

(51) Int. Cl.
*B01F 3/04* (2006.01)

(52) U.S. Cl.
USPC ..... 261/26; 261/94; 261/97; 261/99; 261/100; 261/104; 261/107; 62/440; 62/176.1; 62/176.4; 62/304

(58) Field of Classification Search
USPC ..... 261/26, 94, 97, 99, 100, 104, 107
See application file for complete search history.

(56) References Cited

U.S. PATENT DOCUMENTS

| | | | | |
|---|---|---|---|---|
| 2,289,728 | A * | 7/1942 | Rees | 62/171 |
| 2,709,900 | A | 6/1955 | Zearfoss, Jr. et al. | |
| 3,357,201 | A | 12/1967 | Toyama | |
| 5,417,080 | A | 5/1995 | Bishop | |
| 5,775,580 | A * | 7/1998 | Sizemore et al. | 236/44 E |
| 5,848,534 | A | 12/1998 | Stauffer | |
| 6,637,235 | B2 | 10/2003 | Sakamoto et al. | |
| 6,851,272 | B2 | 2/2005 | Yu | |
| 2005/0217282 | A1 | 10/2005 | Strohm et al. | |
| 2006/0117763 | A1 | 6/2006 | Espinosa et al. | |

FOREIGN PATENT DOCUMENTS

| | | | |
|---|---|---|---|
| GB | 2017285 | | 10/1979 |
| JP | 200611273 | | 4/2006 |
| JP | 2008292079 A | * | 12/2008 |
| WO | 03004950 | | 1/2003 |

OTHER PUBLICATIONS

Partial International Search Report for PCT/US2012/047827, dated Aug. 29, 2013.

* cited by examiner

*Primary Examiner* — Robert A Hopkins
(74) *Attorney, Agent, or Firm* — Pearne & Gordon LLP

(57) ABSTRACT

An enclosure defines a confined space configured to store goods that can be advantageously maintained by controlling the water vapor levels to which the goods are exposed. A water vapor conversion element, at which liquid water is converted to water vapor, can be operably associated with the confined space to distribute that water vapor to the confined space. A water delivery unit is operatively associated with the water vapor conversion element and is configured to deliver water in liquid form to the water vapor conversion element. The water delivery unit can comprise a drip chamber configured to deliver the water essentially one drop at a time. The enclosure can comprise a drawer in a refrigeration appliance such as a household refrigerator. A sensor configured to determine the water vapor level present in the confined space can be operable to selectively control the distribution of water vapor to the confined space.

27 Claims, 2 Drawing Sheets

CONTROLLING THE WATER VAPOR LEVELS IN A CONFINED SPACE

BACKGROUND OF THE INVENTION

1. Field of the Invention

The present invention relates generally to methods and apparatus for controlling the water vapor level that is present in a confined space in which goods can be stored and, in particular, to methods and apparatus for controlling the water vapor level that is present in the confined space of a refrigeration appliance such as in a storage drawer of a household refrigerator.

2. Discussion of the Prior Art

There exists a variety of circumstances as to which the water vapor level present in a confined space in which goods are to be stored is to be controlled. The extent to which water vapor is present in the confined space can be expressed in terms of the humidity of the air contained within the confined space. An example of such a circumstance is associated with refrigeration appliances wherein an objective is to preserve the suitability for use of perishable food items. In certain instances, the water vapor level present in a drawer for storing fruits and vegetables in a household refrigerator can be controlled.

The cold air that is circulated, for example, in the fresh food compartment of a household refrigerator can be quite dry. As a result, fresh fruits and vegetables stored within the fresh food compartment of the refrigerator can give up their water content to the cold, dry air. In that case, the fruits and vegetables can become unsuitable for consumption. This condition can be alleviated somewhat by storing the fruits and vegetables in drawers in the fresh food compartment of the refrigerator; and the condition can be further improved by controlling the amount of water vapor that is present in the space in which the fruits and vegetables are stored so that the fruits and vegetables do not give up to an undesirable extent their water content to the surrounding air.

BRIEF DESCRIPTION OF THE INVENTION

The following sets forth a somewhat simplified summary of the present invention for the purpose of providing a basic understanding of examples of selected aspects of the invention. The summary does not constitute an extensive overview of all aspects or embodiments of the invention. Neither is the summary intended to identify critical aspects or delineate the scope of the invention. The sole purpose of the summary is to present examples of selected aspects of the invention in a simplified form as an introduction to the more detailed description of the invention that follows the summary.

In accordance with one aspect, a system can include an enclosure that defines a confined space that is configured to store goods that can be advantageously maintained by controlling the water vapor levels to which the goods are exposed. The system also can include a water vapor conversion element at which liquid water is converted to water vapor. In that case, the water vapor conversion element can be operably associated with the confined space of the enclosure to distribute the water vapor to the confined space. In addition, the system can include a water delivery unit operatively associated with the water vapor conversion element and configured to deliver water in liquid form to the water vapor conversion element. In a particular aspect, the water vapor conversion element can be located within the confined space defined by the enclosure. In an additional particular aspect, the water conversion element can comprise a glass microfiber element.

And in yet another particulate aspect, the water delivery unit can comprise a drip chamber configured to deliver water in liquid form to the water vapor conversion element essentially one drop at a time. In one embodiment, the enclosure can comprise a drawer in a refrigeration appliance. And in another embodiment, the refrigeration appliance can comprise a household refrigerator.

According to another aspect, the system can include a device that is configured to displace from the water vapor conversion element and distribute to the confined space defined by the enclosure the water vapor converted from water at the water vapor conversion element.

In still another aspect, the system can include a device that is configured to determine the water vapor level that is present in the confined space defined by the enclosure. The device can be operable to selectively control the distribution of water vapor to the confined space defined by the enclosure from the water vapor conversion element. In one embodiment, the device can be operable to selectively control the distribution of water vapor into the confined space defined by the enclosure from the water vapor conversion element based at least in part on the type of goods stored in the confined space defined by the enclosure.

In yet another aspect of the invention, a method is provided for controlling the water vapor level present in a confined space in which goods are stored, the goods being of a kind that can be advantageously maintained by controlling the water vapor levels to which the goods are exposed. The method can include delivering water in liquid form to a water vapor conversion element and having the water delivered in liquid form to the water vapor conversion element converted to water vapor at the water vapor conversion element. The method can further include distributing into the confined space the water vapor converted from water at the water vapor conversion element and controlling the amount of water vapor introduced into the confined space. In a particular embodiment of the method, the confined space can be defined by an enclosure located in a refrigeration appliance. And in a further embodiment, the refrigeration appliance can comprise a household refrigerator.

A further aspect of the foregoing method can include ascertaining a water vapor level to be maintained in the confined space and determining the water vapor level present in the confined space. Water can be delivered to the water vapor conversion element whenever the water vapor level present in the confined space is determined to be less than the water vapor level ascertained to be maintained in the confined space. The amount of water vapor distributed from the water vapor conversion element to the confined space can be controlled to an amount that results in the establishment in the confined space of the water vapor level ascertained to be maintained in the confined space. In a particular embodiment, the water vapor level that is ascertained to be maintained in the confined space can be a function of the type of goods that are stored in the confined space.

In aspects of the foregoing methods, the water can be delivered in liquid form to the water vapor conversion element one drop at a time; and the water vapor can be distributed from the water vapor conversion element to the confined space by displacing the water vapor from the water vapor conversion element.

In yet a further aspect of the foregoing methods, the water vapor conversion element can comprise a glass microfiber element.

BRIEF DESCRIPTION OF THE DRAWINGS

The foregoing and other aspects of the present invention will be apparent to those skilled in the art to which the invention relates from the detailed descriptions of examples of aspects and embodiments of the invention that follow with reference to the accompanying drawings, wherein the same reference numerals are used in the several figures to refer to the same parts or elements and in which.

DETAILED DESCRIPTIONS OF EXAMPLES OF THE INVENTION

Examples of embodiments that incorporate one or more aspects of the present invention are described below with references, in some cases, to the accompanying drawings. These examples are not intended to be limitations on the present invention. Thus, for example, in some instances, one or more of the examples of the present invention described with reference to one aspect or embodiment can be utilized in other aspects and embodiments. In addition, certain terminology is used herein for convenience only and is not to be taken as limiting the present invention.

Figure 1:
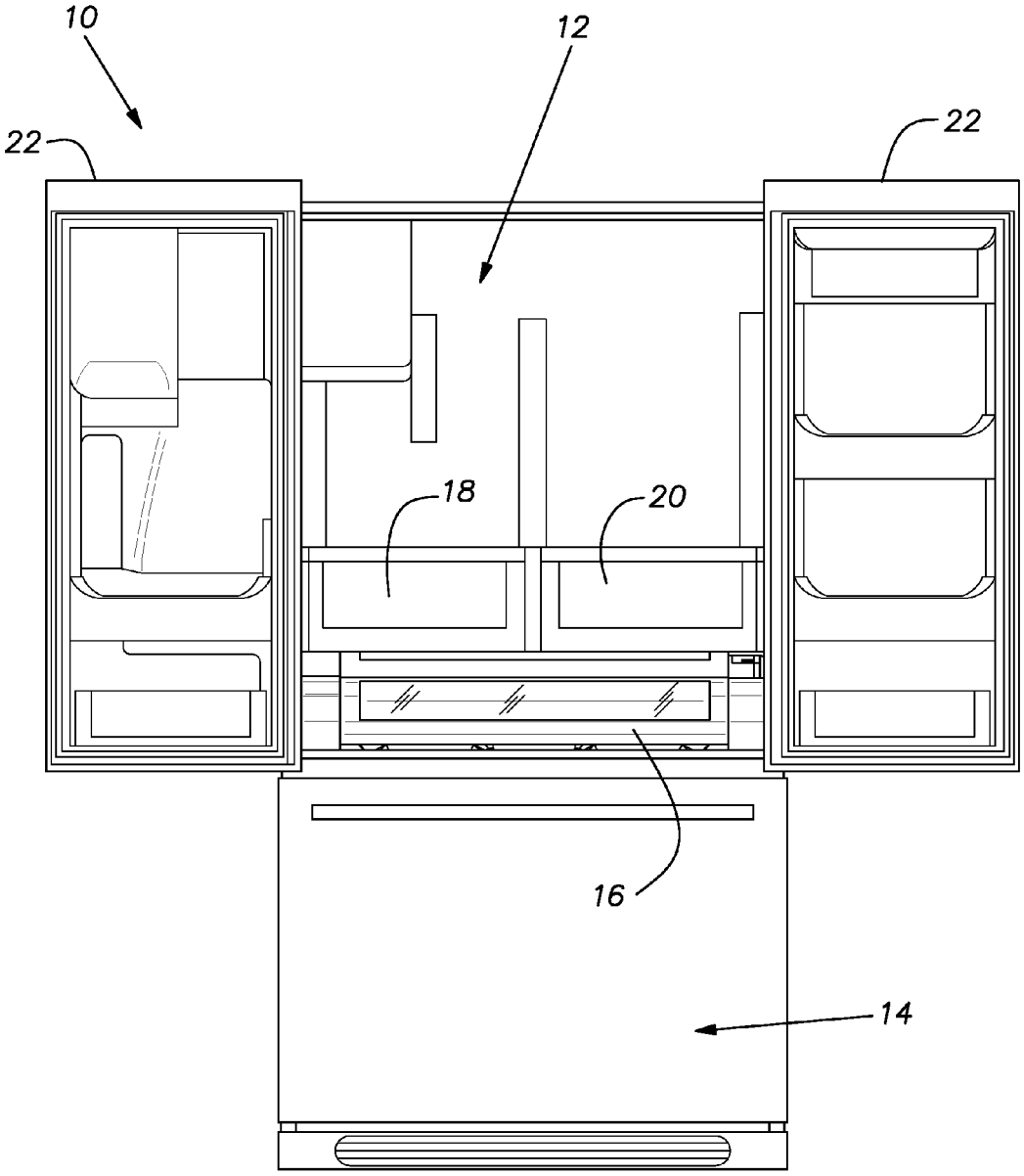
FIG. 1 is a somewhat schematic representation of a household refrigerator to which an embodiment of the present invention can be applied.

The example of an embodiment of the invention that is shown in FIG. 1 of the drawings comprises a refrigeration appliance in the form of a household refrigerator, indicated generally at 10, that includes two refrigerator compartments indicated generally at 12 and 14, respectively. In FIG. 1, the refrigerator compartment 12 comprises a fresh food, or refrigerating, compartment in which articles can be stored at temperatures above their freezing points but low enough to maintain the articles in an acceptable condition for reasonable periods of time. Refrigerator compartment 14 in the embodiment of FIG. 1, which is located beneath the refrigerator compartment 12, comprises a freezer compartment in which articles can be stored at below their freezing points for extended periods of time. In the embodiment of FIG. 1, a pair of doors 22, 22 are illustrated as being open so as to expose the interior of the fresh food compartment 12 while the door for the freezer compartment 14 is shown as being closed. The two doors 22, 22 comprise French-style, or double, doors that are configured to open and close the interior of the fresh food compartment to the ambient environment at the exterior of the refrigerator.

Refrigerators in which the freezer compartments are located beneath the fresh food compartments are sometimes referred to in the art as "bottom-mount" refrigerators. It will be understood by those skilled in the art from a reading of the description that follows that the present invention is not limited to being applied to bottom-mount refrigerators of the type shown in FIG. 1 but can, for example, be applied to so-called side-by-side refrigerators, in which the fresh food and freezer compartments are arranged along side one another, and refrigerators in which the fresh food compartment is located beneath the freezer compartment. In addition, the present invention can be applied to refrigeration appliances other than typical household refrigerators such as, for example, refrigeration appliances that do not include freezer compartments.

Several enclosures in the nature of storage compartment assemblies or drawers, as indicated at 16, 18 and 20, can be located within the interior of the fresh food compartment 12. The enclosures 16, 18 and 20 can be mounted on rails that slide so that the enclosures can be slidably withdrawn from the interior of the fresh food compartment 12 when access to the interior of the enclosures is desired and slidably returned to the interior of the fresh food compartment thereafter. Although not depicted in detail in FIG. 1, the interior of the fresh food compartment also can include shelves and/or additional enclosures in the section of the fresh food compartment that is located above the enclosures 18 and 20 as is typical with the fresh food compartments of refrigerators.

The enclosure 16 can comprise, for example, a storage compartment the temperature of which can be controlled separately from the temperature of the fresh food compartment in general. The enclosures 18 and 20, although they may or may not be capable of having their temperatures controlled separately from the temperature of the fresh food compartment, can, in any event, serve the purpose, for example, of storing goods that are to be stored in an environment separate from the general environment of the interior of the fresh food compartment 12. For example, the enclosures 18 and 20 can serve the purpose of storing fresh fruits and vegetables or other perishables foods within their respective interiors. The interiors of the enclosures 18 and 20 can comprise confined spaces. That is, the interiors of the enclosures can be configured so as not to be open to a significant extent to the environment of the fresh food compartment 12. Thus, for example, the enclosures 18 and 20 when, they are in place within the fresh food compartment, can be located beneath a cover that is mounted in the fresh food compartment and completely seals off the interiors of the enclosures to the environment of the fresh food compartment. Alternatively, for example, the enclosures 18 and 20, when in place in the fresh food compartment, can be located beneath shelves that are mounted in the fresh food compartment and serve to cover the enclosures to an extent that the interiors of the enclosures are open to the fresh food compartment only to a limited degree. In any event, the interiors of the enclosures can be said to comprise confined spaces because gases within the enclosures are not completely free to flow from the interiors of the enclosures to the general environment of the fresh food compartment. Those skilled in the art are familiar in general with these types of enclosure or drawer arrangements.

Figure 2:
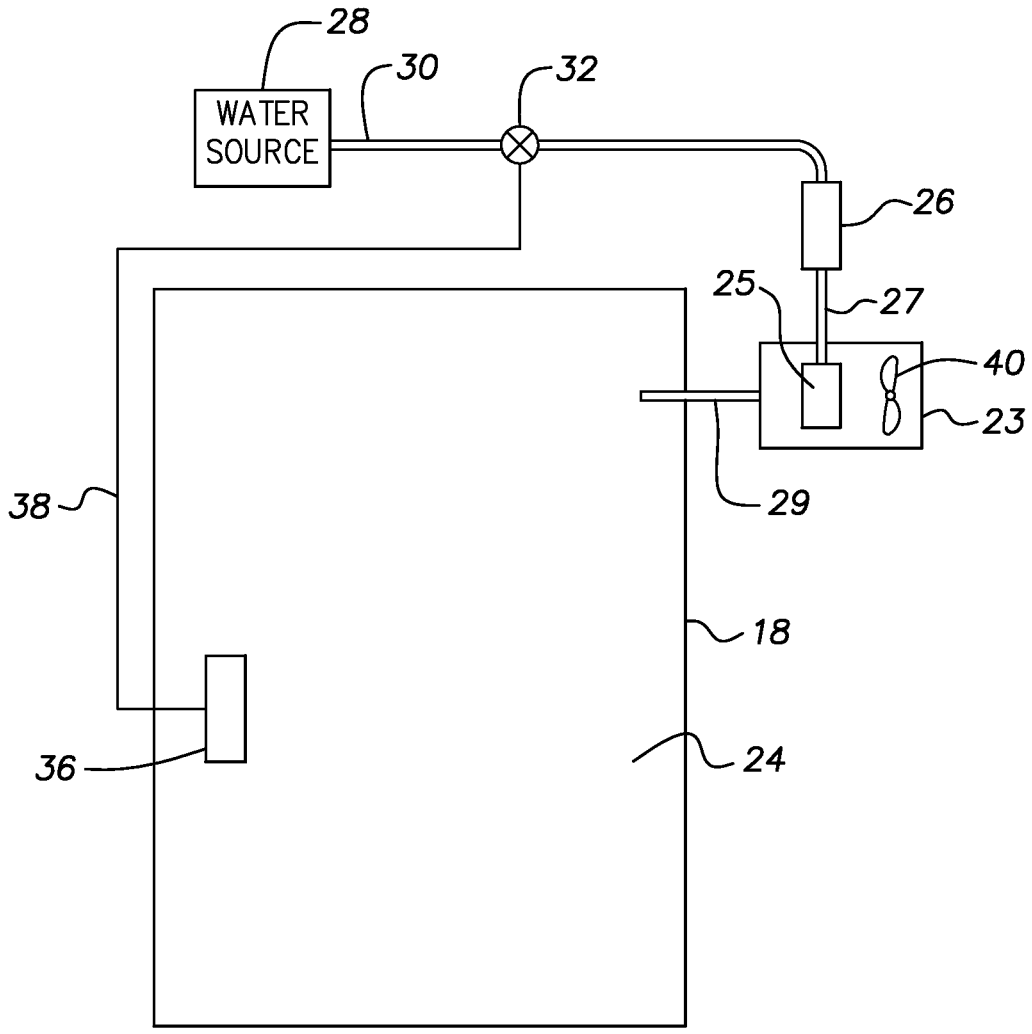
FIG. 2 is a schematic representation of certain elements of an example of the present invention.

FIG. 2 schematically illustrates a system and method that can be applied to an enclosure 18 that defines a confined space, such as in the case of each of the drawers of FIG. 1 for example, that is configured to store goods that can be advantageously maintained by controlling the water vapor levels to which the goods are exposed. The system and method can be employed to maintain the freshness of perishable goods for example. In this connection, the system and method can be useful in maintaining the freshness of fruits and vegetables stored in the confined space or interior of the enclosure or drawer by controlling the water vapor levels that are present in the confined space and to which the fruits and vegetables are exposed.

As illustrated in the example of FIG. 2, the system of the invention can include, in one embodiment, an enclosure 18 defining a confined space 24 configured to store goods, such as fruits and vegetables for example, that can be advantageously maintained by controlling the water vapor levels to which the goods are exposed. The enclosure 18 can, as shown in the embodiment of FIG. 2, comprise a drawer in a refrigeration appliance such as the household refrigerator 10 for example and the confined space 24 can comprise the interior of the enclosure. The system also can include a water vapor conversion element 25 at which liquid water is converted to water vapor. In the embodiment of FIG. 2, the water vapor conversion element 25 is shown as contained within a chamber 23 and operably associated with the confined space 24 of the enclosure, by means of conduit 29 for example, to distribute to the confined space water vapor converted from water at the element 25. In addition, as illustrated in the embodiment of FIG. 2, the system can include a water delivery unit 26 operatively associated with the water vapor conversion element 25, by means of conduit 27 for example, and configured to deliver water in liquid form to the water vapor conversion element 25 through the conduit 27. The conduits 27 and 29 can comprise plastic, rubber or metal tubing for example.

An example of a kind of water vapor conversion element 25 that can be employed in the system of the invention comprises a glass microfiber element. Glass microfiber elements are known to be employed, among other applications, as filtering media and are available in a variety of shapes and sizes, including, for example, discs, cartridges and thimbles. As applied in the embodiment of the invention shown in FIG. 2, as liquid water is delivered to the element 25 through conduit 27 from water delivery unit 26, in the case where the element 25 comprises a glass microfiber element, the water is dispersed through the element 25 by capillary forces present in the element. As a result, the water entering the element 25 assumes a greater surface area so that the water can evaporate more readily at the element 25 than would otherwise be the case. The water vapor resulting from the evaporation of the water at the element 25 can be distributed to the confined space 24 simply under the influence of the forces that cause a state of equilibrium to be established with respect to the water vapor. These forces will cause the water vapor to flow through the conduit 29 to the confined space 24. In an example of another embodiment, a device 40 configured to displace from the water vapor conversion element 25 and distribute to the confined space 24 the water vapor converted at the water vapor conversion element 25 can be employed. In the embodiment of FIG. 2, the device 40 for displacing and distributing the water vapor comprises a fan. The fan is directed toward the element 25 and the air flow generated by the fan passes around and through the element 25, thereby displacing water vapor converted at the element and distributing the water vapor to the confined space 24 through conduit 29. The air movement around and through the element 25 also can enhance the rate of evaporation of the water that is dispersed through the element 25. Examples of water vapor conversion elements 25 that can be employed are the surface of a flat material and the aggregate surface of a granulated material that, in each case, is readily wetted by the liquid water delivered to the surface of the flat or granulated material. As a result of their wetting properties, the water does not bead on these surfaces but is disseminated over the surfaces, whereby the evaporation of the water is enhanced. Examples of the flat material are hydrophilic flat metallic or plastic sheets, and examples of the granulated material are granulated hydrophilic polymers.

In other embodiments of the invention, the water vapor conversion element 25 can be located within, rather than outside, the confined space 24, with or without being accompanied by the device 40, such as the fan shown in FIG. 2. And when located in the confined space 24, the water vapor conversion element 25 can be contained within a chamber such as chamber 23 that would include an opening to the confined space 24 or the element 25 can be directly exposed to the confined space. Although the device 40 can be positioned within the confined space 24 of the enclosure 18 adjacent the element 25, so that it can more directly cause the gases in the confined space of the enclosure to flow around and through the element 25, the device 40 can be located elsewhere within the confined space for the purpose of effectively distributing the water vapor to the confined space.

It will be understood that, in the case of the example of FIG. 2, water should be delivered to the water vapor conversion element 25 from the water delivery unit 26 at a rate that does not overwhelm the ability of the element to convert the liquid water to water vapor. An example of a type of water delivery unit 26 that can accomplish such an objective comprises a drip chamber configured to deliver water in liquid form to the water conversion element 25 essentially one drop at a time. Examples of drip chambers that can be employed as water delivery units 26 include liquid delivery systems of the types that are commonly employed in the medical arts and liquid delivery systems that are sometimes referred to as drip emitters and are employed for irrigation purposes in the agricultural arts. However, the reference to drip chambers herein is intended to cover any apparatus that can deliver water essentially one drop at a time from the source of the water. It can be the case with such apparatus that, from time to time, the delivery of the water may not take place one drop at a time but, in any case, the delivery of the water will occur essentially a drop at a time and not overwhelm the ability of the water vapor conversion unit to convert the water to water vapor.

The water delivery unit 26 is connected to a source of water 28 by means of a conduit 30 that can comprise plastic, rubber or metal tubing for example. A valve 32 is positioned in the conduit 30 and is configured to control the flow of water to the water delivery unit 26 from the source of water 28 by being maintained either in an open condition, at which time water is delivered to the water delivery unit, or a closed position, when the flow of water to the water delivery unit is prevented.

As shown in FIG. 2, the system can include a device 36 that is configured to determine the water vapor level that is present in the confined space 24 of the enclosure 18. The device can comprise, for example, one of any number of types of humidity sensors, electronic or otherwise, familiar to those skilled in the art. The device 36 is operably associated with the valve 32 through the electrical connection 38, for example, so as to open and close the valve 32. Thus, the device 36 functions to selectively control the distribution of water vapor to the confined space 24 of the enclosure 18 from the water vapor conversion element 25 by controlling the flow of water to the element 25 from the water source 28, and the selective control can be based at least in part on the water vapor level that is present in the confined space. Thus, for example, the device 36 can comprise an electronic humidity sensor that can be preset to a selected humidity or water vapor level that is representative of an optimum water vapor level to be maintained in order to satisfactorily preserve the fruits or vegetables stored in the confined space of the enclosure 18; and the sensor can be operable to deliver an electric signal through line 38 to the valve 32, which can comprise a solenoid valve, for example, of a type familiar to those skilled in the art, to selectively open the valve when the water vapor level in the confined space 24 is equal to or less than the preset water vapor level and close the valve whenever the water vapor level in the confined space is greater than the preset water vapor level. In another embodiment, the device 36 can be operatively associated with a control device such as a microprocessor, for example, and the microprocessor appropriately connected to both the valve 32 and the device 40, such as a fan, to control the operation of each. The use of the microprocessor to control the operation of valves and fans is familiar to those skilled in the art. The microprocessor can be appropriately programmed so that upon receiving an electric signal from the device 36, the microprocessor functions to cause the device 40 to turn on or off and the valve 32 to either open or close.

In order to prevent the valve 32 and/or device 40 from continuously switching from one operational mode to another, the sensor 36 can be preset so that the sensor does not issue a triggering signal causing the valve 32 to close and the fan 40 to turn off until the sensed water vapor level reaches a value that is somewhat less than the optimum value and does not issue a triggering signal causing the valve 32 to open and the fan to turn on until the sensed water vapor level is somewhat greater than the optimum value. In other words, the result will be that the valve 32 will be closed and the device off over a range of values above and below the value at which the sensor 36 is preset.

The water vapor level to be maintained within the confined space 24 of the enclosure 18 can be dependent on a variety of factors. For example, in a case in which a single variety of a fruit or vegetable is to be stored in the enclosure, an optimum water vapor level to be maintained in order to satisfactorily preserve that variety of fruit or vegetable will be known to those skilled in the art. This knowledge, or information, can be suitably communicated to the user in pamphlets, for example, that accompany the refrigeration appliance in which the enclosure 18 is located, and the optimum level can be the basis for the user presetting the sensor 36. In instances where more than one variety of fruit and/or vegetable is to be stored in the enclosure 18, the optimum water vapor level to be maintained can be a value that represents a compromised value taking into account the optimum value of each variety that is to be stored. In any case, the sensor 36 that is configured to determine the water vapor level that is present in the confined space 24 of the enclosure 18 can be operable to selectively control the introduction of water to the water vapor conversion element 25 from the drip chamber based at least in part on the type of goods that are stored in the confined space of the enclosure.

An additional control means that can be provided for the purpose of controlling the distribution of water vapor to the confined space 24 of the enclosure 18 comprises a damper, not shown. The damper can be located, for example, so as to control the flow of water vapor from the water vapor conversion element 25 to and through the conduit 29. And the sensor 36 can be operably associated with the damper to control the operation of the damper either directly or through a microprocessor that can be provided to control the operation of the valve 32 and the device 40 as well.

Provisions can be made for presetting the water vapor sensor 36 either directly or remotely. In other words, the sensor can include a mechanism that allows the sensor to be preset by the user directly accessing the sensor or the sensor can be remotely preset by operably connecting the sensor to a preset selection interface located at the exterior of the refrigeration appliance in which the enclosure 18 is located using, for example, suitable electrical components. The interface can provide for the selection of the optimum water vapor level to be made in at least two ways. For example, the selection can be made based on a display at the interface of numerical water vapor values or based on a display at the interface of a listing of goods that are to be stored in the enclosure. In the former case, a user can select at the display a particular numerical water vapor level to be applied in the enclosed space 24, and that information can be electrically communicated to either the sensor or a microprocessor to which the display and the sensor are operably connected. In the case in which the selection of a particular type of goods selected at the user interface is used, the selection can be converted at the user interface to a water vapor level value or the selected information communicated to the microprocessor that converts the selection that has been made to a water vapor level value. In either case, the water vapor level value is input to the sensor and the sensor electrically preset to the selected water vapor level value.

In the foregoing description, reference has been made to the use of electrical components to operably connect certain of the system components in a manner so that they can perform their required functions. As will be understood by those skilled in the art, however, other types of communicating components such as pneumatic and hydraulic components, for example, can be used as well.

It will be understood from the foregoing description of the embodiment of FIG. 2 that the present invention provides for a method of controlling the water vapor level present in a confined space in which goods are stored, the goods being of a kind that can be advantageously maintained by controlling the water vapor levels to which the goods are exposed. The method can include delivering water in liquid form to a water vapor conversion element and having the water that is delivered in liquid form to the water vapor conversion element converted to water vapor at the water vapor conversion element. The method also can include distributing into the confined space the water vapor that is converted at the water vapor conversion element and controlling the amount of water vapor introduced into the confined space. The method also can include ascertaining a water vapor level to be maintained in the confined space, determining the water vapor level present in the confined space and delivering the water to the water vapor conversion element whenever the water vapor level present in the confined space is determined to be less than the water vapor level ascertained to be maintained in the confined space. The amount of water vapor distributed from the water vapor conversion element into the confined space is controlled to an amount that results in the establishment in the confined space of the water vapor level ascertained to be maintained in the confined space. The water vapor level ascertained to be maintained in the confined space can be a function of the type of goods that are stored in the confined space.

Also in the foregoing method, the water can be selectively delivered in liquid form to the water vapor conversion element one drop at a time and the water vapor can be distributed to the confined space by displacing the water vapor from the water vapor conversion element as can be accomplished by forcing air through the element. The method can be carried out in the case where the confined space is defined by a drawer in a refrigeration appliance such as a household refrigerator. In the method, the water vapor conversion element can comprise a glass microfiber element.

While the present invention has been described above and illustrated with reference to certain embodiments, aspects and examples thereof, it is to be understood that the invention is not so limited. Modifications and alterations will occur to those skilled in the art upon reading the specification with reference to the drawings. In any event, the present invention covers and includes any and all modifications and variations to the described embodiments, aspects and examples that are encompassed by the following claims.

What is claimed is:

1. A system including:

an enclosure defining a confined space configured to store goods that can be advantageously maintained by controlling the water vapor levels to which the goods are exposed;

a water vapor conversion element located outside the confined space at which liquid water is converted to water vapor;

a conduit having a first end connected to the water vapor conversion element and a second end connected to the confined space of the enclosure and configured to distribute said water vapor to the confined space; and a water delivery unit operatively associated with the water vapor conversion element and configured to deliver water in liquid form to the water vapor conversion element.

2. The system of claim 1 wherein the water vapor conversion element comprises a glass microfiber element.

3. The system of claim 1 wherein the water delivery unit comprises a drip chamber configured to deliver water in liquid form to the water vapor conversion element essentially one drop at a time.

4. The system of claim 3 wherein the water vapor conversion element comprises a glass microfiber element.

5. The system of claim 1 including a device configured to displace water vapor from the water vapor conversion element and distribute said water vapor to the confined space defined by the enclosure.

6. The system of claim 5 including a device configured to determine the water vapor level present in the confined space defined by the enclosure, the device being operable to control the distribution of water vapor from the water vapor conversion element to the confined space defined by the enclosure.

7. The system of claim 1 wherein the enclosure comprises a drawer in a refrigeration appliance.

8. The system of claim 7 wherein the refrigeration appliance comprises a household refrigerator.

9. The system of claim 3 including a device configured to displace water vapor from the water vapor conversion element and distribute said water vapor to the confined space defined by the enclosure.

10. The system of claim 9 including a device configured to determine the water vapor level present in the confined space defined by the enclosure, the device being operable to control the distribution of water vapor from the water vapor conversion element into the confined space defined by the enclosure.

11. The system of claim 10 wherein the enclosure comprises a drawer in a refrigeration appliance.

12. The system of claim 11 wherein the refrigeration appliance comprises a household refrigerator.

13. The system of claim 12 wherein the device configured to determine the water vapor level present in the confined space defined by the enclosure is operable to control the distribution of water vapor from the water vapor conversion element to the confined space defined by the enclosure based at least in part on the type of goods stored in the confined space defined by the enclosure.

14. The system of claim 12 wherein the water vapor conversion element comprises a glass microfiber element.

15. The system of claim 1 including a programmable user interface enabling user selection of one of several pre-selected water vapor levels based at least in part on the type of goods that are stored in the confined space of the enclosure wherein the user interface indicates the type of goods corresponding with the respective pre-selected water vapor levels.

16. A method of controlling a water vapor level present in a confined space in which goods are stored, the goods being of a kind that can be advantageously maintained by controlling the water vapor level to which the goods are exposed, including:

delivering water in liquid form to a water vapor conversion element outside the confined space;

converting the water delivered in liquid form to a water vapor conversion element to a water vapor at the water vapor conversion element;

distributing into the confined space the water vapor converted from water at the water vapor conversion element by means of a conduit; and controlling the amount of water vapor introduced into the confined space.

17. The method of claim 16 wherein the water selectively delivered in liquid form to the water vapor conversion element is delivered one drop at a time.

18. The method of claim 17 wherein the water vapor is distributed to the confined space by displacing the water vapor from the water vapor conversion element.

19. The method of claim 18 wherein the confined space is defined by an enclosure located in a refrigeration appliance.

20. The method of claim 19 wherein the refrigeration appliance comprises a household refrigerator.

21. The method of claim 16 including:

ascertaining a water vapor level to be maintained in the confined space;

determining the water vapor level present in the confined space;

delivering water to the water vapor conversion element whenever the water vapor level present in the confined space is determined to be less than the water vapor level ascertained to be maintained in the confined space; and controlling the amount of water vapor distributed from the water vapor conversion element to the confined space to an amount that results in the establishment in the confined space of the water vapor level ascertained to be maintained in the confined space.

22. The method of claim 21 wherein the water delivered in liquid form to the water vapor conversion element is delivered one drop at a time.

23. The method of claim 22 wherein the confined space is defined by an enclosure located in a refrigeration appliance.

24. The method of claim 23 wherein the refrigeration appliance comprises a household refrigerator.

25. The method of claim 24 wherein the water vapor is distributed from the water vapor conversion element to the confined space by displacing the water vapor from the water vapor conversion element.

26. The method of claim 22 wherein the water vapor level ascertained to be maintained in the confined space is a function of the type of goods stored in the confined space.

27. The method of claim 24 wherein the water vapor conversion element comprises a glass microfiber element.

* * * * *